US011358698B1

(12) United States Patent
Snyder et al.

(10) Patent No.: US 11,358,698 B1
(45) Date of Patent: Jun. 14, 2022

(54) SYSTEMS AND METHODS FOR SYNCHRONIZING SHIFTING ACROSS MARINE PROPULSION DEVICES

(71) Applicant: Brunswick Corporation, Mettawa, IL (US)

(72) Inventors: Matthew W. Snyder, Fond du Lac, WI (US); Charles A. Lubitz, Fond du Lac, WI (US); Mitchell J. Baer, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 427 days.

(21) Appl. No.: 16/733,825

(22) Filed: Jan. 3, 2020

(51) Int. Cl.
*B63H 23/28* (2006.01)
*F02D 25/02* (2006.01)
*F02D 41/02* (2006.01)

(52) U.S. Cl.
CPC ..... *B63H 23/28* (2013.01); *F02D 25/02* (2013.01); *F02D 41/0225* (2013.01)

(58) Field of Classification Search
CPC ..... B63H 23/28; F02D 25/02; F02D 41/0225
See application file for complete search history.

(56) References Cited

U.S. PATENT DOCUMENTS

| | | | | |
|---|---|---|---|---|
| 6,273,771 | B1 | 8/2001 | Buckley et al. | |
| 6,966,805 | B1 | 11/2005 | Caldwell | |
| 8,454,402 | B1 | 6/2013 | Arbuckle et al. | |
| 9,555,869 | B1 | 1/2017 | Arbuckle et al. | |
| 9,878,768 | B1 | 1/2018 | Vanselous et al. | |
| 10,336,427 | B1 * | 7/2019 | Ichikawa | F02D 11/106 |
| 2003/0003824 | A1 * | 1/2003 | Katayama | F02D 13/0226 440/88 F |
| 2014/0141663 | A1 * | 5/2014 | Kuriyagawa | B63H 25/00 440/1 |
| 2021/0155326 | A1 * | 5/2021 | Yoshimura | B63H 21/14 |

* cited by examiner

*Primary Examiner* — Andrew Polay
(74) *Attorney, Agent, or Firm* — Andrus Intellectual Property Law, LLP

(57) ABSTRACT

A method for synchronizing shifting of transmissions across marine propulsion devices. The method includes receiving a signal to shift the transmissions and identifying a predetermined shifting time for each of the transmissions, where the predetermined shifting time represents an elapsed time between starting the shifting and completing the shifting. The method further includes comparing the predetermined shifting times to determine a longest shifting time, calculating for each of the transmissions an offset time that is a difference between the corresponding predetermined shifting time and the longest shifting time, and sending a signal to start the shifting of each of the transmissions after waiting the offset time for that transmission such that the transmissions all complete the shifting at the same time.

20 Claims, 5 Drawing Sheets

SYSTEMS AND METHODS FOR SYNCHRONIZING SHIFTING ACROSS MARINE PROPULSION DEVICES

FIELD

The present disclosure generally relates to systems and methods for synchronizing shifting across marine propulsion devices, and more particularly by synchronizing to the slowest shifting time of the marine propulsion devices.

BACKGROUND

The following U.S. Patents and Patent Applications provide background information and are incorporated by reference in entirety.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,966,805 discloses a marine transmission for connecting a driven shaft to a driving shaft provided with first and second dog clutch members and first and second friction clutch members which are actuated, respectively, by first and second hydraulically actuated devices. Engagement of the friction clutch members with each other creates rotation in the driven shaft that approaches or equals the rotational speed of the driving shaft so that subsequent engagement of the first and second dog clutch members can be accomplished without significant relative rotational speed differences between the two dog clutch members.

U.S. Pat. No. 8,454,402 discloses propulsion systems for marine vessels having an internal combustion engine rotating a driveshaft; an electric motor; a transmission selectively connecting the rotating driveshaft to a propulsor via a rotating gear; and a control circuit controlling the electric motor to slow rotation of the driveshaft and gear when a shift into the gear is requested.

U.S. Pat. No. 9,555,869 discloses a method for setting an engine speed of an internal combustion engine in a marine propulsion device of a marine propulsion system to an engine speed setpoint includes determining the engine speed setpoint based on an operator demand and predicting a position of a throttle valve that is needed to achieve the engine speed setpoint. The method also includes determining a feed forward signal that will move the throttle valve to the predicted position, and after moving the throttle valve to the predicted position, adjusting the engine speed with a feedback controller so as to obtain the engine speed setpoint. An operating state of the marine propulsion system is also determined. Depending on the operating state, the method may include determining limits on an authority of the feedback controller to adjust the engine speed and/or determining whether the operator demand should be modified prior to determining the engine speed setpoint.

U.S. Pat. No. 9,878,768 discloses a marine transmission that includes a synchronizer on a counter rotating shaft to shift into a high speed gear. The synchronizer includes friction surfaces on both sides of the gear body for the high speed gear. The high speed gear mesh is helical and generates axial force that enhances the torque carrying capacity of synchronizing friction surfaces, thereby enabling the shifting into the high speed gear without torque interrupt.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a method for synchronizing shifting of transmissions across marine propulsion devices. The method includes receiving a signal to shift the transmissions and identifying a predetermined shifting time for each of the transmissions, where the predetermined shifting time represents an elapsed time between starting the shifting and completing the shifting. The method further includes comparing the predetermined shifting times to determine a longest shifting time, calculating for each of the transmissions an offset time that is a difference between the corresponding predetermined shifting time and the longest shifting time, and sending a signal to start the shifting of each of the transmissions after waiting the offset time for that transmission such that the transmissions all complete the shifting at the same time.

Another embodiment generally relates to a propulsion system for a marine vessel. The propulsion system includes at least two marine propulsion devices each having an engine and a transmission. The propulsion system further includes a control system configured to receive a signal to initiate shifting the transmissions, to access, for each of the marine propulsion devices, a predetermined shifting time that represents an elapsed time between starting the shifting and completing the shifting, to compare the predetermined shifting time for each of the transmissions to determine a longest shifting time, and to calculate, for each of the transmissions, an offset time that is a difference between the predetermined shifting time corresponding thereto and the longest shifting time. The control system is further configured to, in response to the signal to initial shifting, starting the shifting of each of the transmissions only after the offset time corresponding thereto has lapsed such that the transmissions complete the shifting at the same time.

Another embodiment generally relates to a method for synchronizing shifting of first and second transmissions for first and second marine propulsion devices, respectively. The method includes receiving a signal to shift the first and second transmissions and identifying predetermined shifting times for the first and second transmissions, where the predetermined shifting times represent elapsed times between starting the shifting and completing the shifting of the first and second transmissions, respectively, and where the predetermined shifting times are provided as a function of engine RPM. The method further includes comparing the predetermined shifting times to determine a longest shifting time and calculating, for the first and second transmissions, offset times that are a difference between the predetermined shifting times and the longest shifting time, respectively. The method further includes sending separate signals to the first and second transmissions to start the shifting thereof, and separately starting the shifting of the first and second transmissions after the offset times corresponding thereto have lapsed, respectively.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

The present disclosure generally relates to shifting for transmissions across multiple marine propulsion devices provided on a marine vessel. Through experimentation and development, the inventors have identified that as more and more marine propulsion devices are provided on a single marine vessel, and as multi-speed transmissions are provided therewith, the asynchronous timing of shifting events across these marine propulsion devices becomes more apparent. In particular, the inventors have recognized that the uncoordinated shifting across multiple marine propulsion devices causes undesirable effects with respect to the noise, vibration, and harmonics for operating the marine vessel. In other words, an operator is forced to make a tradeoff between a pleasant operating experience having fewer marine propulsion devices and/or those having a single-speed transmission, or enjoying the additional performance and power of increased marine propulsion devices or speeds of their operation.

Figure 1:
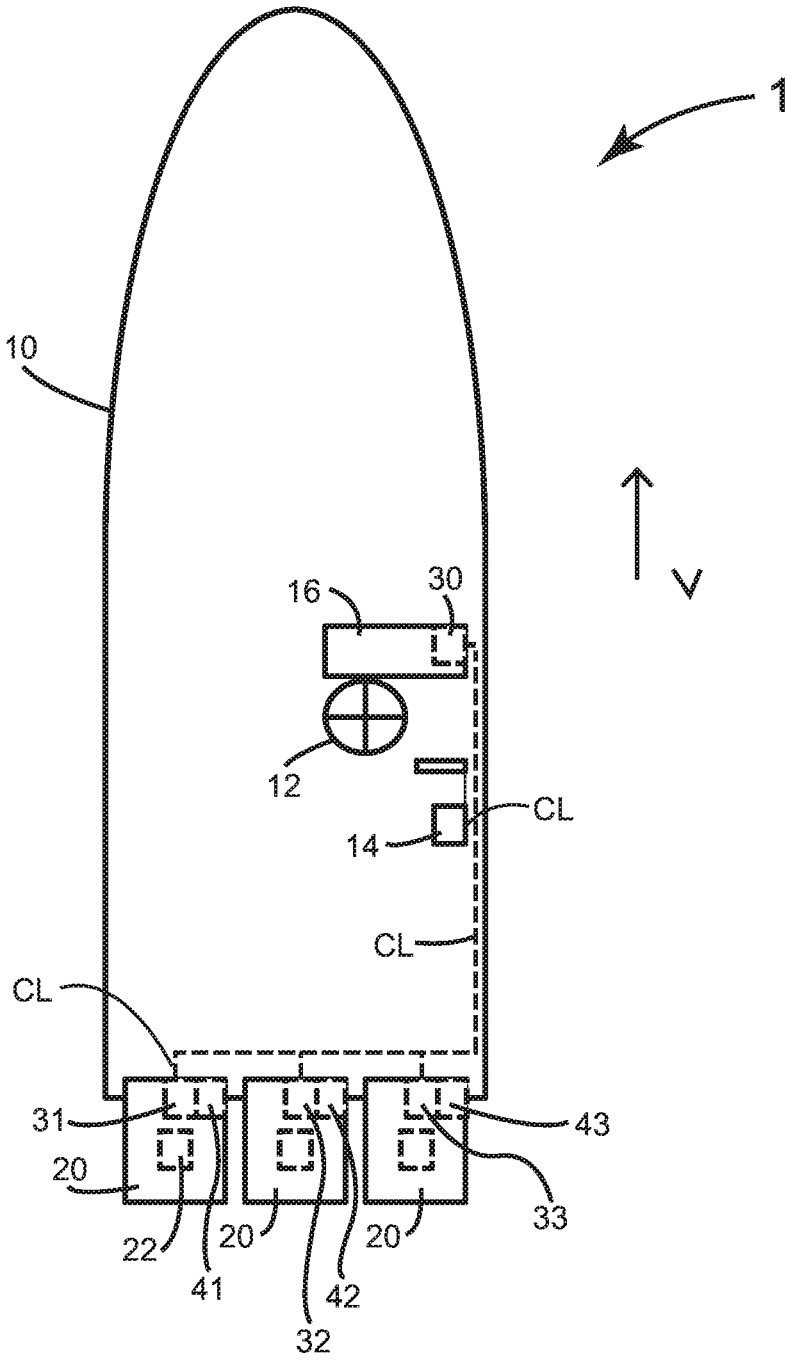
FIG. 1 is a top view of schematic representation for a marine vessel incorporating the systems and methods of the present disclosure.

FIG. 1 depicts an exemplary system 1 for operating a marine vessel 10 according to the present disclosure. The marine vessel 10 is provided with multiple marine propulsion devices 20, in the present case shown to have three. It should be recognized that any number of marine propulsion devices 20 beyond two are equally applicable to the present disclosure, including marine vessels 10 having six or more marine propulsion devices 20, for example. Exemplary marine propulsion devices 20 include inboard and outboard motors having internal combustion engines rotating propellers, jet drives, pod drives, and the like.

The marine propulsion devices 20 propel the marine vessel 10 through the water at a velocity V, which are steerable by manipulation of a steering device 12, such as a steering wheel as known in the art. A throttle controller 14 operatively coupled to central controller 30 within a helm control system 16, for example through a control link CL (e.g., via a CAN Kingdom network), to control operation of each marine propulsion device 20. The central controller 30, all engine control units (ECUs, discussed below), and any other controllers are collectively referred to as a control system 100, which is shown in FIG. 2 and discussed further below.

In the example shown in FIG. 1, a transmission 22 is also provided with each marine propulsion device 20, which may provide two or more speeds in the forward direction, for example. The transmission 22 rotatably couples each of the engines to a propeller shaft to transfer power to the propellers and propel the marine vessel 10 in the forward and rearward direction, for example. The transmission 22 in certain embodiments is further shiftable into a plurality of gears (e.g., $1^{st}$ forward gear, $2^{nd}$ forward gear, and reverse gear), as well as in a neutral "gear" or position in which rotation of the engine is not transmitted further to the propeller shaft. An exemplary transmission known in the art is Mercury Quicksilver part number 3600-808065A 5 (Blacktrac Transmission or Mercruiser). Each of the marine propulsion devices 20 is provided with an engine control unit 31-33, which may control operations of the marine propulsion devices 20. The engine control unit 31-33 may also be structured in the same manner as the control system 100 shown in FIG. 2 and discussed below. Each marine propulsion device 20 is further provided with a sensor 41-43 configured to determine any lapsed time between starting a shifting event and the completion of that event, which will be discussed further below.

Figure 2:
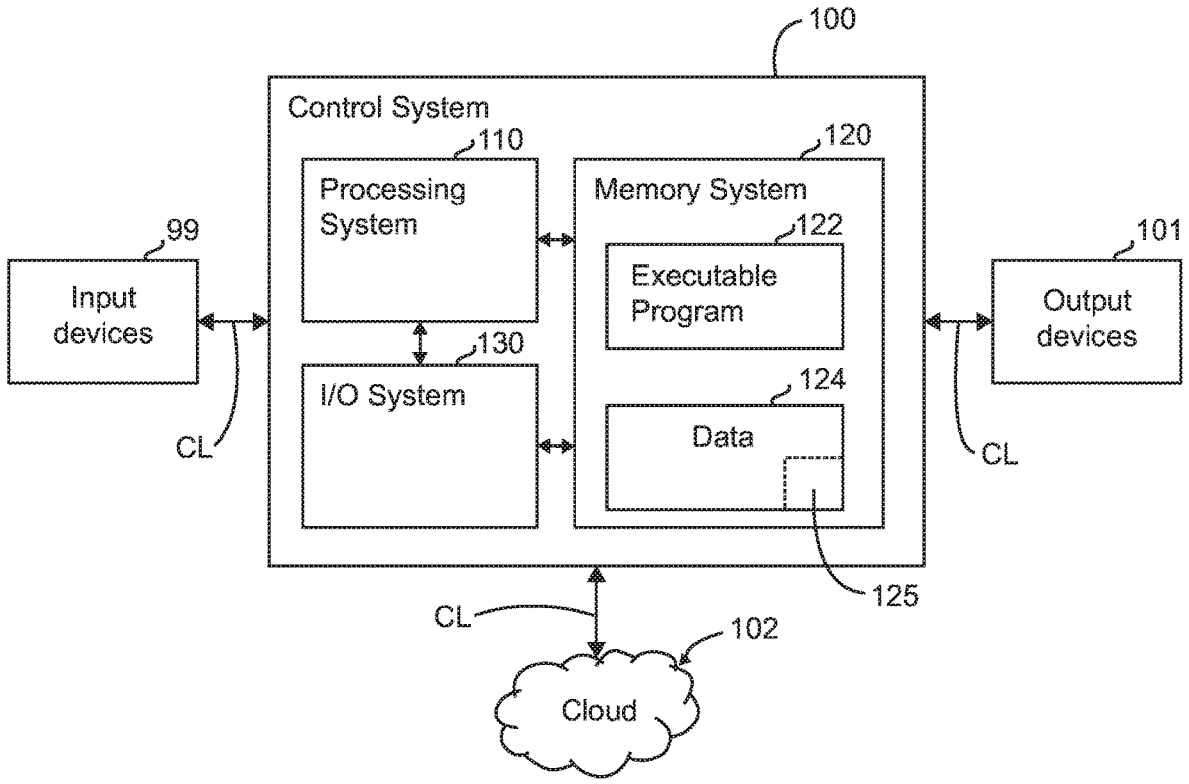
FIG. 2 is a schematic representation of a control system such as may be incorporated within the system shown in FIG. 1.

Additional information is now provided for the exemplary control system 100 shown in FIG. 2. Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 100 communicates with each of the one or more components of the system 1 via a communication link CL, which can be any wired or wireless link. The control system 100 is capable of receiving information and/or controlling one or more operational characteristics of the system 1 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the system 1. Moreover, the communication link CL lines are meant only to demonstrate that the various control elements are capable of communicating with one another, and do not represent actual wiring connections between the various elements, nor do they represent the only paths of communication between the elements. Additionally, the system 1 may incorporate various types of communication devices and systems, and thus the illustrated communication links CL may in fact represent various different types of wireless and/or wired data communication systems.

As noted above, the components shown in the control system 100 of FIG. 2 may be replicated and/or divided across many different elements within the system 1, including the central controller 30, engine control units 31-33, and others, such as a propulsion control unit (PCU). The control system 100 of FIG. 2 includes a processing system 110, memory system 120, and input/output (I/O) system 130 for communicating with other devices, such as input devices 99 and output devices 101, either of which may also or alternatively be stored in a cloud 102. The processing system 110 loads and executes an executable program 122 from the memory system 120, accesses data 124 stored within the memory system 120, and directs the system 1 to operate as described in further detail below.

The processing system 110 may be implemented as a single microprocessor or other circuitry, or be distributed across multiple processing devices or sub-systems that cooperate to execute the executable program 122 from the memory system 120. Non-limiting examples of the processing system include general purpose central processing units, application specific processors, and logic devices.

The memory system 120 may comprise any storage media readable by the processing system 110 and capable of storing the executable program 122 and/or data 124. The memory system 120 may be implemented as a single storage device, or be distributed across multiple storage devices or sub-systems that cooperate to store computer readable instructions, data structures, program modules, or other data. The memory system 120 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

As discussed above, the inventors have identified that in a marine vessel 10 having multiple marine propulsion devices 20, each marine propulsion device 20 is allowed to shift at its own schedule. This leads to different shifting times based on the respective acceleration rates for each marine propulsion device 20. Even across identical models of marine propulsion devices 20, differences due to the tolerance of components, as well as wear and tear for each marine propulsion device 20, and/or other effects of operation (such as turning the marine vessel 10 or operating in a side current) results in each of the marine propulsion devices 20 shifting at a different point in time, and also differing shifting durations between the start of the shift and the completion of that shift. As discussed above, the inventors have recognized this variation in shifting to be undesirable.

In order to synchronize the shifting events across multiple marine propulsion devices 20, the system 1 shown in FIGS. 1 and 2 provides for a central controller 30 operatively coupled to each of the marine propulsion devices 20, whereby the central controller 30 receives a signal to initiate shifting the transmissions 22 of each of these marine propulsion devices 20 at separate given times. In other words, once it is determined that the transmission 22 in at least one of the marine propulsion devices 20 should be shifted into a different gear (e.g., first gear to second gear), the shifting process for each respective transmission 22 may be started at a different time. This original signal requesting a shift for all marine propulsion devices 20 may arise when the first of the marine propulsion devices 20 reaches a certain engine RPM, when a particular command is provided by the throttle controller 14, or under other operating circumstances in which shifting the marine propulsion devices 20 would be advantageous, for example.

A memory system 120 stores a lookup table 125 containing a predetermined shifting time ST1-ST3 for each of the given marine propulsion devices 20. The predetermined shifting times ST1-ST3 represent an elapsed time between the shift starts S1-S3 start and shift complete C1-C3 for shifting each of the marine propulsion devices 20, respectively. In certain examples, the predetermined shifting times ST1-ST3 are determined empirically using methods known in the art, such as sensors monitoring the rotation of a driveshaft within each marine propulsion device 20 and comparing to a threshold RPM associated with starting and completing a shift, for example. In certain embodiments, the predetermined shifting times ST1-ST3 are updated over time. It will be recognized that these predetermined shifting times ST1-ST3 may further vary as a function of marine propulsion device 20 RPM, temperature, or other operational characteristics having an impact on shift timing.

The system 1 further includes a processing system 110 that compares the predetermined shifting times ST1-ST3 for each of the marine propulsion devices 20 to determine a longest shifting time LST across the collection marine propulsion devices 20 for the marine vessel 10. The processing system 110 further calculates an offset time OT1-OT3 for each of the marine propulsion devices 20, which is the difference between the predetermined shifting times ST1-ST3 for these marine propulsion devices 20 and the longest shifting time LST or a time longer than LST.

Once the signal to initiate the shifting of all marine propulsion devices 20 is received from the user (e.g., by the central controller 30), the central controller 30 sends a signal for each of the marine propulsion devices 20 to start the shifting process only after the corresponding offset time OT1-OT3 has lapsed, such that each marine propulsion device 20 completes its shifting at the same time as the other marine propulsion devices 20. In other words, the shift start S1-S3 for each marine propulsion device 20 is delayed such that every marine propulsion device 20 will have a shift complete C1-C3 at the same time, based on which of the marine propulsion devices 20 has the slowest predetermined shift time ST1-ST3 (the longest shift time LST). In practice, one or more of the marine propulsion devices 20 may nevertheless have a shift complete that is out of sync with the others, measured as a delta time DT1-DT3 in the case of three marine propulsion devices 20. Delta times DT1-DT3 may be the result of additional wear and tear since the predetermined shifting times ST1-ST3 were originally determined, or may be caused by variations in RPM, temperature, and/or the like. In certain embodiments, delta times DT1-DT3 may be incorporated into artificial intelligence or machine learning to further improve the predetermined shifting times ST1-ST3 for any marine propulsion devices 20 identified as being out of sync with the others.

Figure 3:
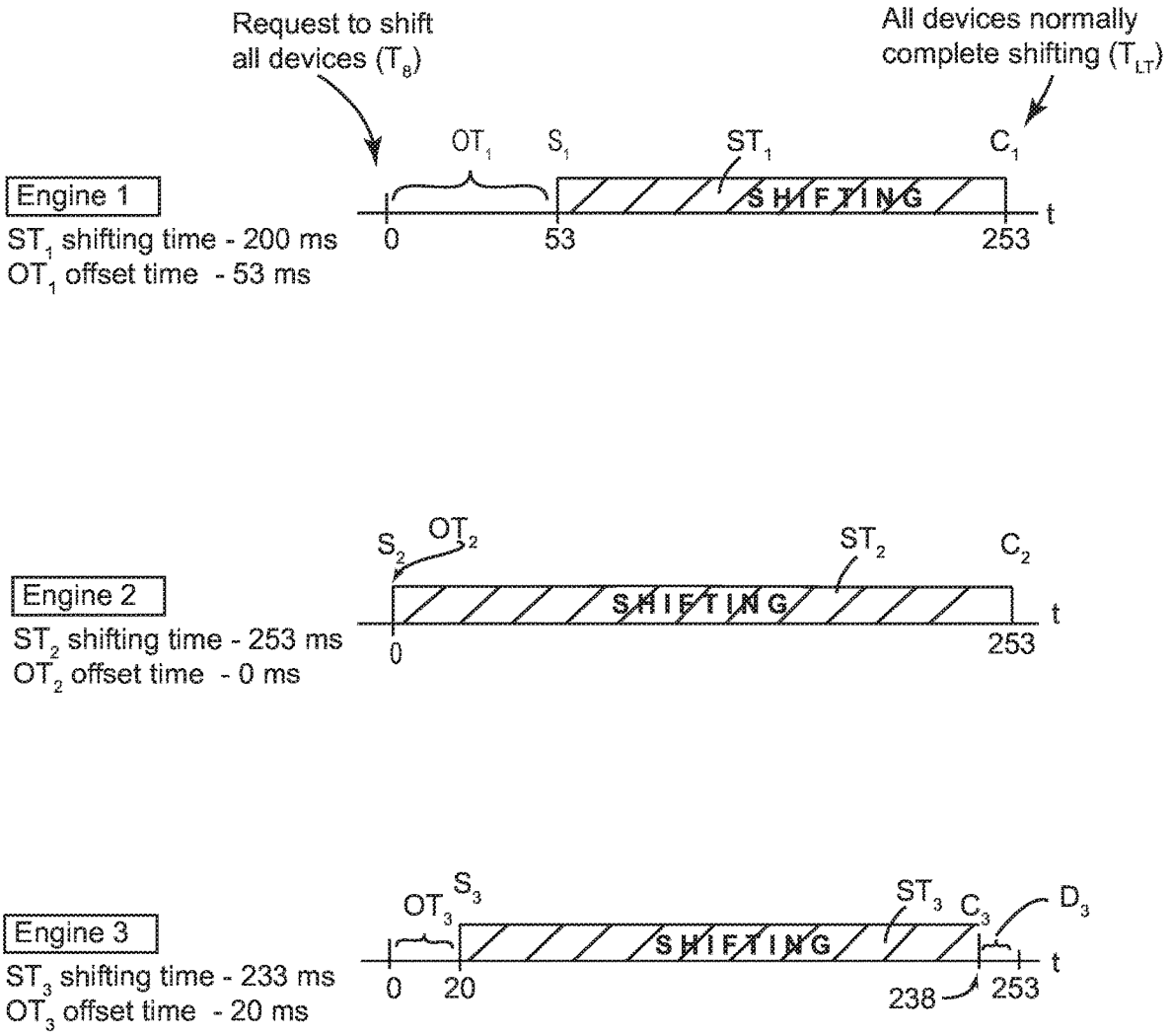
FIG. 3 depicts exemplary plots for shifting multiple marine propulsion devices according to the present disclosure.

FIG. 3 depicts a plot showing the shifting of three marine propulsion devices 20 to be synchronized according to the present disclosure. In the example shown, the three marine propulsion devices 20 are shown as Engines 1-3, having corresponding predetermined shift times ST1-ST3. In the present case, the longest shifting time LST would be determined to be the predetermined shift time ST2 corresponding to Engine 2 which is the longest of all the predetermined shift times ST1-ST3 at 253 ms. Based on this longest shifting time LST of 253 ms, the correspondingly calculated offsets times OT1-OT3 are 53 ms, Oms (corresponding to the longest predetermined shift time ST3), and 20 ms, for example.

As shown, the shift start S1-S3 for each of the marine propulsion devices 20 is then delayed for each corresponding offset time OT1-OT3, such that after each of the predetermined shift times ST1-ST3 has completed, the shift complete C1-C3 of each marine propulsion device 20 should occur approximately simultaneously. As discussed above, it may happen that one of the shift completes (in this case C3 for engine 3) of one marine propulsion device 20 does not actually occur at the time intended. In this case, the delta time D3 may be incorporated into an updated predetermined shift time ST3 for the engine 3, for example through machine learning or artificial intelligence, such that subsequent shifting events for engine 3 result in a delta time D3 of 0. The delta times D1-D3 may be so short that they are indiscernible by the user. However, updating the data stored in the memory system 120 nonetheless allows the system 1 to continuously update and learn in the pursuit of a perfect synchronization of shift events (e.g., shifting from a first gear to a second gear) across all marine propulsion devices 20.

Figure 4:
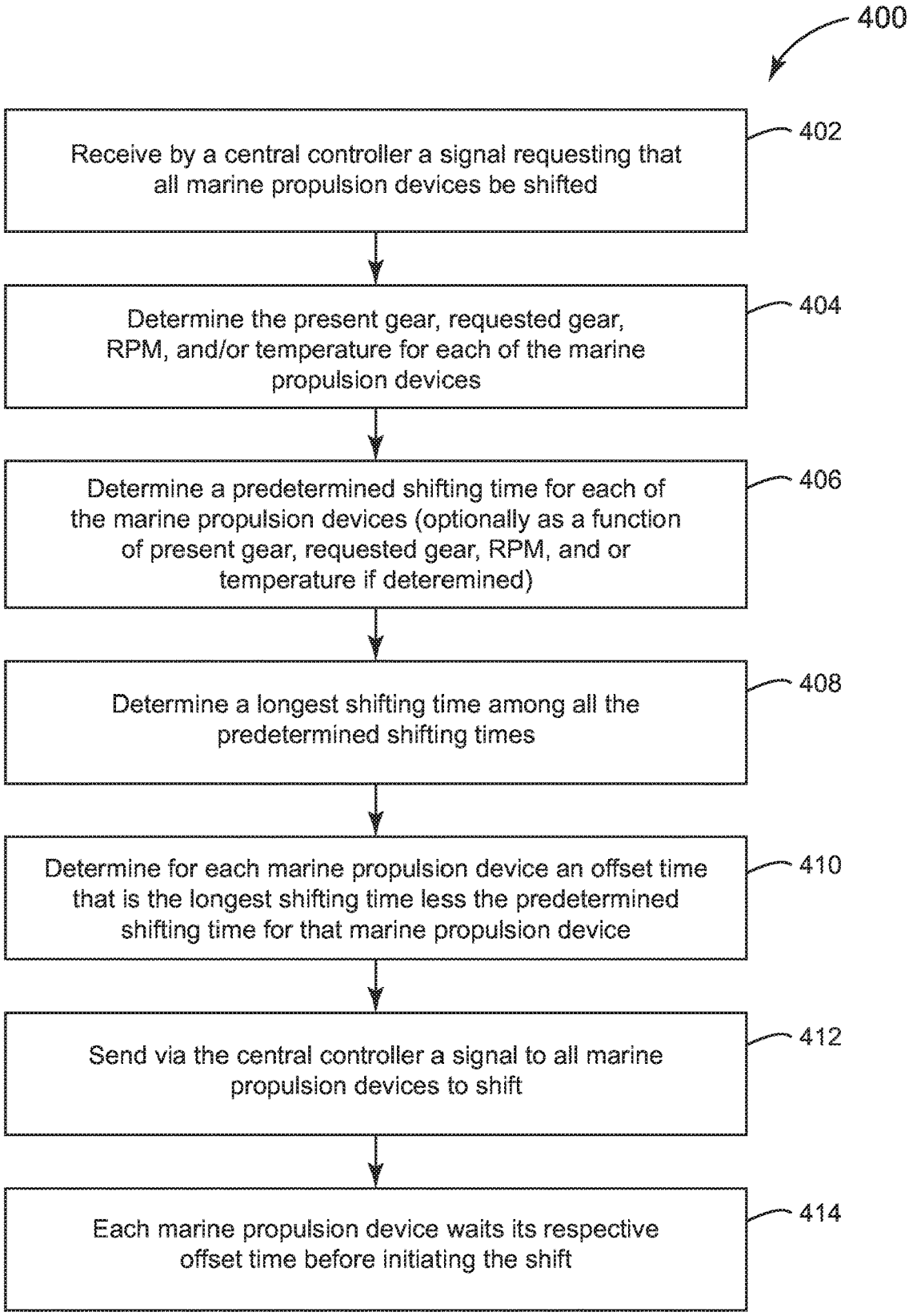
FIGS. 4 and 5 depict two exemplary process flows for synchronizing shifting according to the present disclosure.
Figure 5:
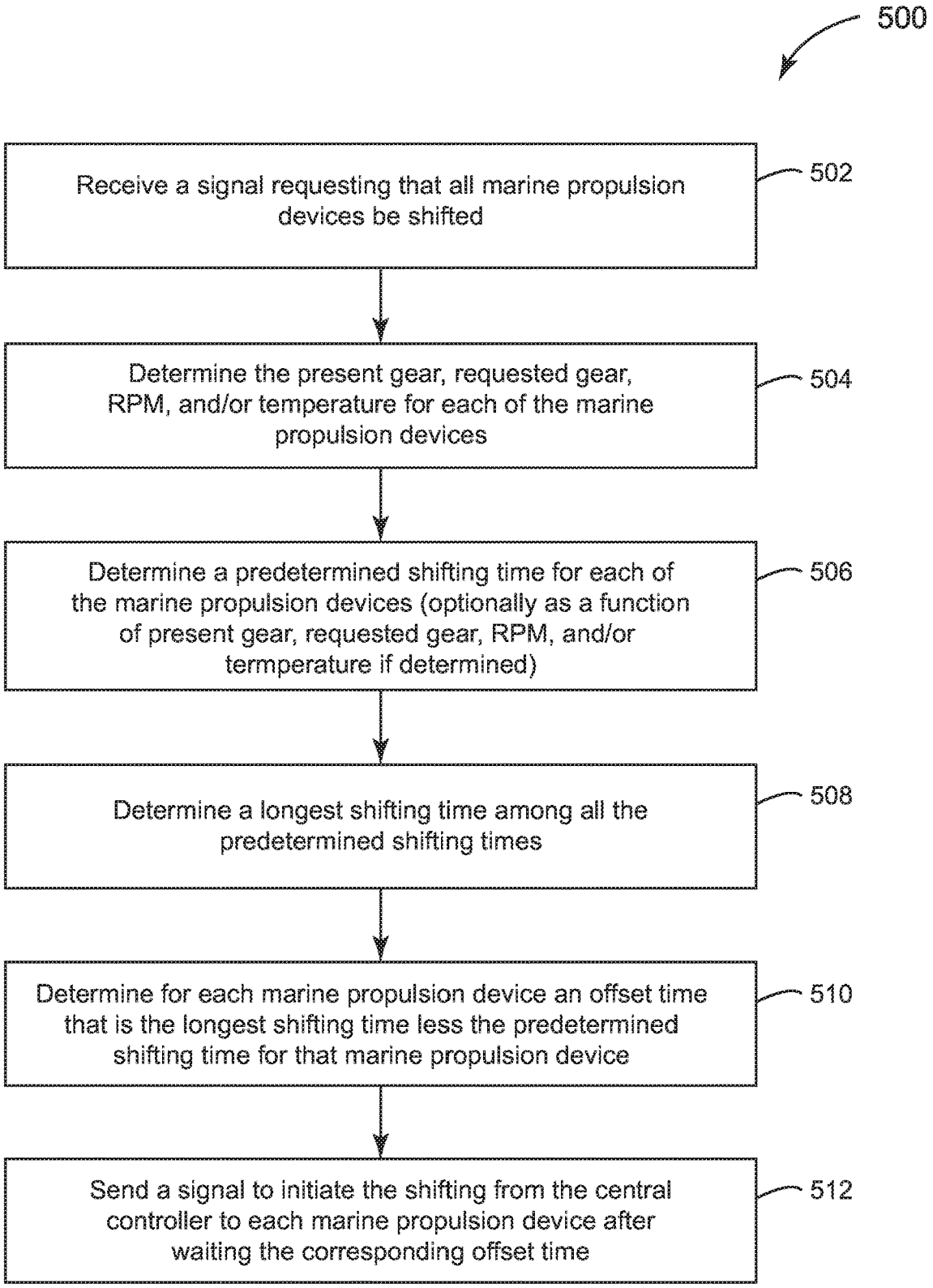

FIGS. 4 and 5 depict two exemplary process flows for synchronizing shifting of marine propulsion devices 20 according to the present disclosure, such as might result in the shifting shown in FIG. 3. The process 400 of FIG. 4 begins by receiving via the central controller 30 a signal requesting that all marine propulsion devices 20 be shifted in step 402. In certain examples, step 404 provides for the determination of a present gear, requested gear to be shifted into, RPM, temperature, or other information for each of the marine propulsion devices 20, which may be provided by the sensor 41-44 corresponding thereto, for example. This information is then used in step 406 to determine a predetermined shifting time ST1-ST3 for each of the marine propulsion devices 20.

The longest shifting time LST among the predetermined shift times ST1-ST3 is determined in step 408, which is used to subsequently determine for each of the marine propulsion devices 20 an offset time OT1-OT3 that is the difference between the longest shifting time LST and the predetermined shifting time ST1-ST3 corresponding thereto in step 410. In certain examples, step 412 provides for sending via the central controller 30 a signal to all marine propulsion devices 20 to shift, whereupon in step 414 each marine propulsion device 20 then waits its respective offset time OT1-OT3 before initiating its start shift S1-S3.

In contrast, the process 500 of FIG. 5 begins the same as the process 400 of FIG. 4 whereby steps 402-410 correspond to steps 502-510. However, in the process 500, instead of the central controller 30 sending a signal to all marine propulsion devices 20 to shift at a single instance, (whereby the delay for the offset times OT1-OT3 is handled within each marine propulsion device independently), the central controller 30 instead performs the waiting and sends separate corresponding starting signals to each marine propulsion device 20 only after its corresponding offset time OT1-OT3 has lapsed.

In this manner, the presently disclosed systems and methods essentially provide for a singular shifting even across all marine propulsion devices 20 for each gear shift (e.g., first gear to second gear), rather than multiple audible and tactile events corresponding to the number of marine propulsion devices 20 on the marine vessel 10.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A method for synchronizing shifting of transmissions across marine propulsion devices, the method comprising:

receiving a signal to shift the transmissions;

identifying a predetermined shifting time for each of the transmissions, wherein the predetermined shifting time represents an elapsed time between starting the shifting and completing the shifting;

comparing the predetermined shifting times to determine a longest shifting time;

calculating for each of the transmissions an offset time that is a difference between the corresponding predetermined shifting time and the longest shifting time; and sending a signal to start the shifting of each of the transmissions after waiting the offset time for that transmission such that the transmissions all complete the shifting at the same time.

2. The method according to claim 1, wherein the predetermined shifting time for each of the transmissions is provided as a function of an RPM corresponding thereto.

3. The method according to claim 1, wherein the predetermined shifting time for each of the transmissions is provided as a function of a temperature corresponding thereto.

4. The method according to claim 1, wherein the shifting includes a first shift into a first gear and a second shift into a second gear, and wherein the predetermined shifting time for each of the transmissions includes a first time and a second time corresponding to the first shift and the second shift, respectively.

5. The method according to claim 1, wherein the signal to start the shifting for each of the transmissions is provided by a central controller operatively coupled to each of the marine propulsion devices.

6. The method according to claim 5, wherein the signal to start the shifting is sent to each of the marine propulsion devices after waiting the offset time corresponding thereto.

7. The method according to claim 1, wherein the predetermined shifting time for each of the transmissions is stored within the marine propulsion device corresponding thereto.

8. The method according to claim 1, wherein the sending of the signal to execute the shifting of each of the transmissions is performed by an engine control unit associated with the marine propulsion device corresponding thereto.

9. The method according to claim 8, further comprising measuring an actual shifting time between the starting and the completion of the shifting for each of the transmissions, and updating the predetermined shifting time for each of the transmissions to reflect the actual shifting time corresponding thereto.

10. The method according to claim 9, wherein the updating is performed on a continuous basis as a running average.

11. The method according to claim 8, wherein the updating is performed on a periodic basis.

12. The method according to claim 1, wherein the marine propulsion devices are outboard motors and the transmissions have at least two forward gears, wherein the signal to shift the transmissions is from a first gear of the two forward gears to a second gear of the two forward gears.

13. A propulsion system for a marine vessel, the propulsion system comprising:

at least two marine propulsion devices each having a transmission; and a control system configured to:

receive a signal to initiate shifting the transmissions;

access, for each of the marine propulsion devices, a predetermined shifting time that represents an elapsed time between starting the shifting and completing the shifting;

compare the predetermined shifting time for each of the transmissions to determine a longest shifting time;

calculate, for each of the transmissions, an offset time that is a difference between the predetermined shifting time corresponding thereto and the longest shifting time; and in response to the signal to initial shifting, starting the shifting of each of the transmissions only after the offset time corresponding thereto has lapsed such that the transmissions complete the shifting at the same time.

14. The system according to claim 13, wherein each of the marine propulsion devices stores the offset time for the transmission corresponding thereto.

15. The system according to claim 13, wherein each of the marine propulsion devices determines when the offset time for the transmission corresponding thereto has lapsed and thereafter starts the shifting.

16. The system according to claim 13, wherein the predetermined shifting times for the transmissions are provided as a function of engine RPM.

17. The system according to claim 13, wherein the control system is further configured to measure an actual shifting time between the starting and the completion of the shifting for each of the transmissions, and to update the predetermined shifting time for each of the transmissions to reflect the actual shifting time corresponding thereto.

18. The method according to claim 17, wherein the predetermined shifting time for each of the transmissions is updated on a continuous basis.

19. The method according to claim 13, wherein the transmissions have at least two forward speeds.

20. A method for synchronizing shifting of first and second transmissions for first and second marine propulsion devices, respectively, the method comprising:

receiving a signal to shift the first and second transmissions;

identifying predetermined shifting times for the first and second transmissions, wherein the predetermined shifting times represent elapsed times between starting the shifting and completing the shifting of the first and second transmissions, respectively, and wherein the predetermined shifting times are provided as a function of engine RPM;

comparing the predetermined shifting times to determine a longest shifting time;

calculating, for the first and second transmissions, offset times that are a difference between the predetermined shifting times and the longest shifting time, respectively;

sending separate signals to the first and second transmissions to start the shifting thereof; and separately starting the shifting of the first and second transmissions after the offset times corresponding thereto have lapsed, respectively.

* * * * *